US008763922B2

(12) United States Patent
Leary

(10) Patent No.: US 8,763,922 B2
(45) Date of Patent: Jul. 1, 2014

(54) METHOD AND APPARATUS FOR INSTALLING A RAILING SYSTEM

(75) Inventor: Steven J. Leary, Barnegat, NJ (US)

(73) Assignee: Vinylast, Inc., Lakewood, NJ (US)

( * ) Notice: Subject to any disclaimer, the term of this patent is extended or adjusted under 35 U.S.C. 154(b) by 249 days.

(21) Appl. No.: 13/107,169

(22) Filed: May 13, 2011

(65) Prior Publication Data

US 2012/0286117 A1 Nov. 15, 2012

(51) Int. Cl.
*E01B 9/00* (2006.01)

(52) U.S. Cl.
USPC ..... 238/342; 248/475.1; 248/300; 248/200; 238/310; 238/315

(58) Field of Classification Search
USPC ..... 248/300, 200, 188.8, 188.91, 503.1, 248/500, 231.9, 475.1; 238/310, 215, 316, 238/338, 342, 343, 349
See application file for complete search history.

(56) References Cited

U.S. PATENT DOCUMENTS

| | | | | | |
|---|---|---|---|---|---|
| 497,679 | A | * | 5/1893 | Newbury | 248/72 |
| 690,138 | A | * | 12/1901 | Ford | 238/91 |
| 764,362 | A | * | 7/1904 | Knox | 238/338 |
| 776,342 | A | * | 11/1904 | McCormick | 238/70 |
| 907,563 | A | * | 12/1908 | Braine | 238/315 |
| 915,376 | A | * | 3/1909 | Pfautz et al. | 238/338 |
| 948,375 | A | * | 2/1910 | Knox | 238/338 |
| 975,520 | A | * | 11/1910 | Galambos | 238/71 |
| 1,070,270 | A | * | 8/1913 | Link | 238/77 |
| 1,315,132 | A | * | 9/1919 | Knox | 238/338 |
| 1,441,401 | A | * | 1/1923 | Coughlin | 238/85 |
| 1,571,008 | A | * | 1/1926 | Hilpert | 238/282 |
| 2,140,891 | A | * | 12/1938 | Boyce | 238/351 |
| 5,025,987 | A | * | 6/1991 | Kotecki et al. | 238/351 |
| 7,021,855 | B2 | * | 4/2006 | Hardtke et al. | 403/168 |

* cited by examiner

*Primary Examiner* — Kimberly Wood

(57) ABSTRACT

In one embodiment, the invention is method and apparatus for installing a railing system. In one embodiment, a bracket for mounting a rail to a support surface includes a first surface, a second surface positioned in a substantially parallel orientation relative to the first surface, and a third surface connecting the first surface and the second surface, where at least one of the first surface or the second surface has a perimeter that is at least partially curved.

14 Claims, 4 Drawing Sheets

METHOD AND APPARATUS FOR INSTALLING A RAILING SYSTEM

FIELD OF THE INVENTION

The present invention relates generally to railing systems and relates more specifically to the installation of railing systems.

BACKGROUND OF THE DISCLOSURE

Railing systems are commonly used to provide stability and support to structures such as stairways, landings, and decks. Conventional railing systems include three main components: a sub rail, a top rail positioned over the sub rail, and a mounting bracket that secures the sub rail to a support surface (e.g., a wall). However not all railing systems are installed in exactly the same manner.

For instance, some railing systems are installed in a perpendicular orientation relative to the support surface (e.g., as in the case of a landing), whereas other railing systems are installed in an angled orientation relative to the support surface (e.g., as in the case of a stairway). Different mounting brackets are typically used depending on whether the orientation of the railing system relative to the support surface is perpendicular or angled. Thus, an individual installing a railing system must keep a variety of mounting brackets handy, which can be expensive. The need for different mounting brackets can also increase the amount of time it takes to install the railing system if any modifications are made to the design.

SUMMARY OF THE INVENTION

In one embodiment, the invention is method and apparatus for installing a railing system. In one embodiment, a bracket for mounting a rail to a support surface includes a first surface, a second surface positioned in a substantially parallel orientation relative to the first surface, and a third surface connecting the first surface and the second surface, where at least one of the first surface or the second surface has a perimeter that is at least partially curved.

BRIEF DESCRIPTION OF THE DRAWING

The teachings of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION

In one embodiment, the invention is a method and apparatus for installing a railing system. Embodiments of the present invention provide a uniform mounting bracket that is capable of securing a sub rail to a support surface at substantially any relative angle. In one embodiment the mounting bracket is formed of a sturdy material such as a metal, a die cast metal, a polymer, or a polymer-based substance such as vinyl.

Figure 1:
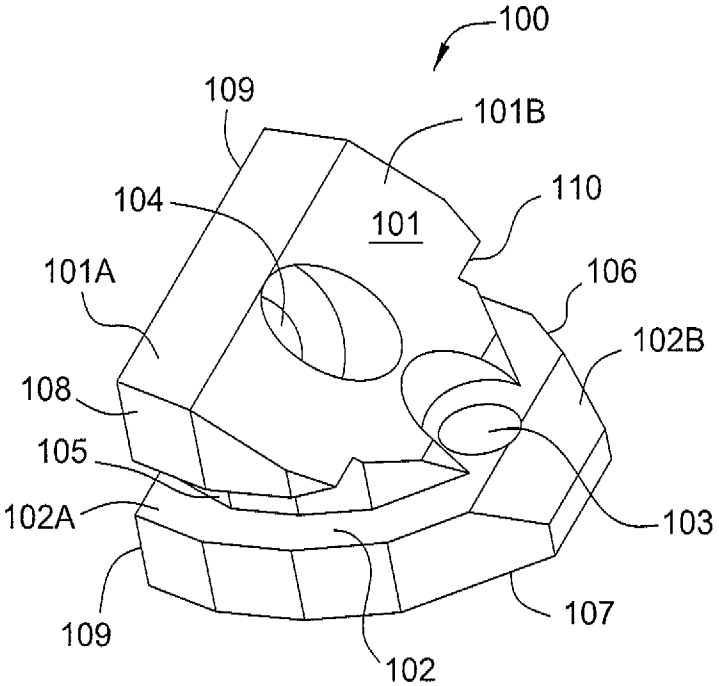
FIG. 1 is an isometric view illustrating one embodiment of a mounting bracket, according to the present invention.
Figure 4:
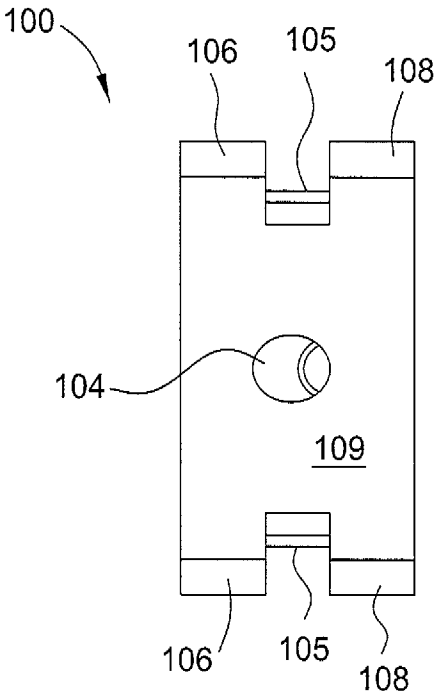
FIG. 4 is a perspective view illustrating the "bottom" of the mounting bracket of FIG. 1.
Figure 3:
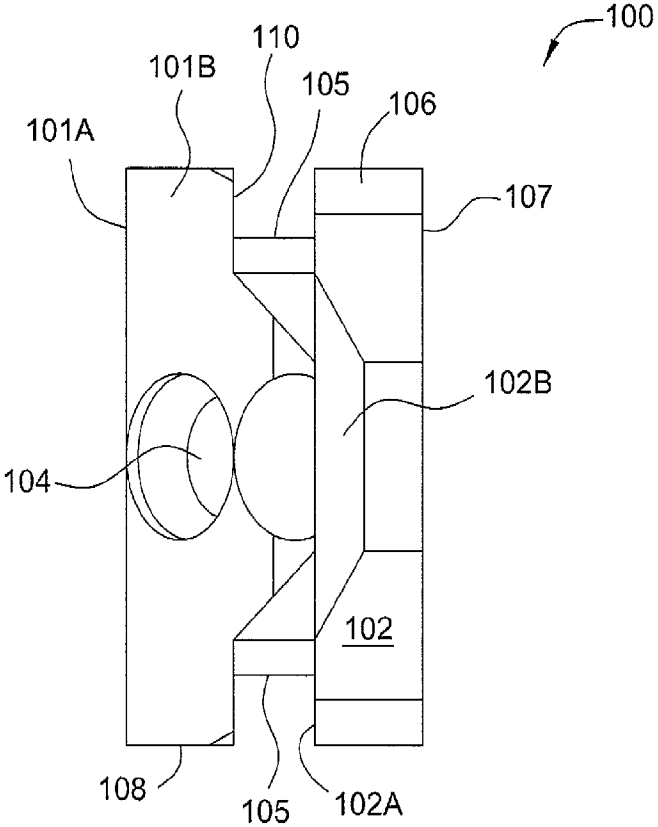
FIG. 3 is a perspective view illustrating the "top" of the mounting bracket of FIG. 1.
Figure 2:
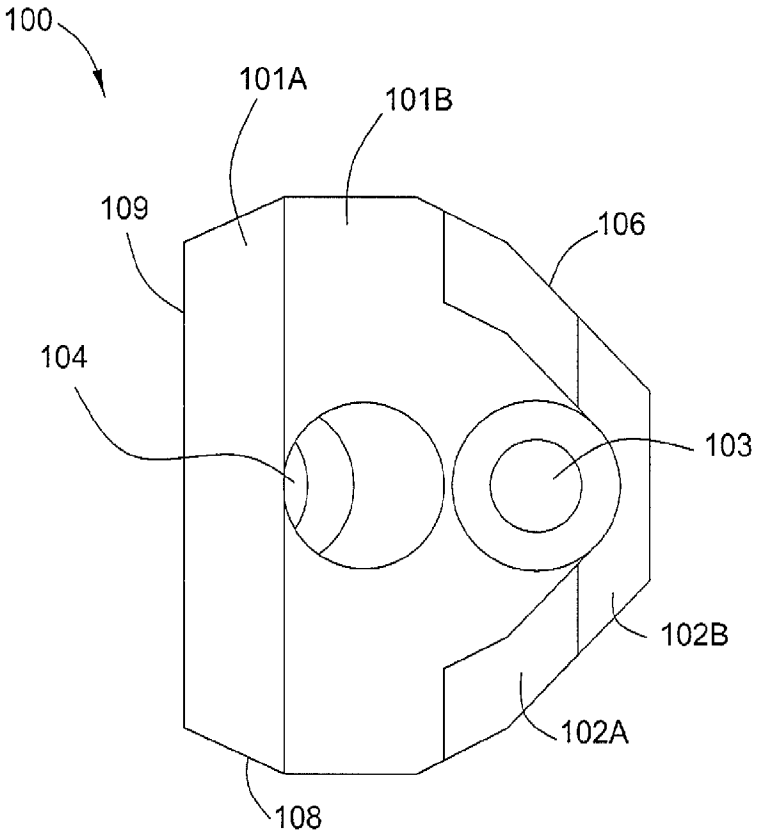
FIG. 2 is a perspective view illustrating a first side of the mounting bracket of FIG. 1.

FIG. 1 is an isometric view illustrating one embodiment of a mounting bracket 100, according to the present invention. As discussed above, the mounting bracket 100 is used to secure a sub rail of a railing system to a support surface such as a wall. FIG. 2 is a perspective view illustrating a first side of the mounting bracket 100 of FIG. 1. FIG. 3 is a perspective view illustrating the "top" of the mounting bracket 100 of FIG. 1. FIG. 4 is a perspective view illustrating the "bottom" of the mounting bracket 100 of FIG. 1. Although terms such as "side," "top," and "bottom" are used to describe the relative orientation of certain portions of the bracket 100, these terms do not imply any overall orientation or positioning of the bracket 100 in use. For instance, depending on the context of use, the "bottom" of the bracket 100 could be positioned higher than the "top" of the bracket 100.

Referring simultaneously to FIGS. 1-4, the mounting bracket 100 generally comprises three primary surfaces: a first surface 102, a second surface 101, and a third surface 109 that spaces the first surface 102 from the second surface 101.

The first surface 102 is substantially planar and has a partially circular perimeter 106. A first side 107 of the first surface 102 is substantially flat. An opposing second side of the first surface 102, however, comprises two distinct sub-surfaces: a substantially flat first sub-surface 102A and a sloped second sub-surface 102B. In particular, the first sub-surface 102A is substantially parallel with the first side 107 of the first surface 102. The second sub-surface 102B meets the first sub-surface 102A, but slopes from the first sub-surface 102A toward the first side 107. In an alternative embodiment, the second side of the first surface 102 may comprise a single, substantially flat surface (i.e., without distinct sub-surfaces).

In addition, at least one aperture 103 extends through the first surface 102, near the area where the first sub-surface 102A and the second sub-surface 102B of the second side meet. Specifically, one end of the aperture 103 is formed in the first side 107, while the other end of the aperture 103 is formed in the second side. In one embodiment, the aperture 103 is a counter-sunk hole.

As discussed above, the perimeter 106 of the first surface 102 is partially circular. More specifically, a portion of the perimeter 106 is substantially straight, while a remainder of the perimeter 106 is substantially circular. In one embodiment, the substantially circular portion of the perimeter 106 is beveled, smoothly curved, or chamfered.

The second surface 101 is spaced apart from the first surface 102 by the third surface 109. A first side 110 of the second surface 101 is substantially flat. An opposing second side of the second surface 101, however, comprises two distinct sub-surfaces: a substantially flat first sub-surface 101A and a sloped second sub-surface 101B. In particular, the first sub-surface 101A is substantially parallel with the first side 110 of the second surface 101. The second sub-surface 101B meets the first sub-surface 101A, but slopes from the first sub-surface 101A toward the first side 110. In one embodiment, the second sub-surface 101B of the second surface 101 is sloped at the same angle as the second sub-surface 102B of the first surface 102. In an alternative embodiment, the second side of the second surface 101 may comprise a single, substantially flat surface (i.e., without distinct sub-surfaces).

In addition, at least one aperture 104 extends through the second surface 101, near the center of the second first sub-surface 101B. Specifically, one end of the aperture 104 is formed in the second surface 101, while the other end of the aperture 104 is formed in the third surface 109. Thus, the aperture 104 has a central axis that is disposed at an acute angle relative to the third surface 109. In one embodiment, the aperture 104 is a counter-sunk hole.

The perimeter 108 of the second surface 101 is partially circular. More specifically, a portion of the perimeter 108 is substantially straight, while a remainder of the perimeter 108 is substantially circular. The substantially straight and substantially circular portions of the second surface's perimeter 108 are aligned with the substantially straight and substantially circular portions of the first surface's perimeter 106. In one embodiment, the substantially circular portion of the perimeter 108 is beveled, smoothly curved, or chamfered.

The third surface 109 is most clearly illustrated in FIG. 4. The third surface 109 is substantially flat and is orientated in a substantially perpendicular manner relative to the first surface 102 and the second surface 101. As discussed above, the third surface 109 actually couples, in a spaced apart manner, the first surface 102 and the second surface 101. The joining of the first surface 102 and the second surface 101 via the third surface 109 results in the formation of a channel 105 that resides between the first surface 102 and the second surface 101 and follows the perimeters 106 and 108 of the first surface 102 and the second surface 101: thus, the channel is perimetric in that it bounds the perimeters 106 and 108. The channel 105 mimics the beveled, smoothly curved, or chamfered perimeters 106 and 108.

As discussed above, one end of the aperture 104 is formed in the third surface 109. In one embodiment, this end of the aperture 104 lies approximately in the center of the third surface 109; however, this may not be the case in other embodiments.

In one embodiment the mounting bracket 100 is formed of a sturdy material such as a metal, a die cast metal, a polymer, or a polymer-based substance such as vinyl.

Figure 5:
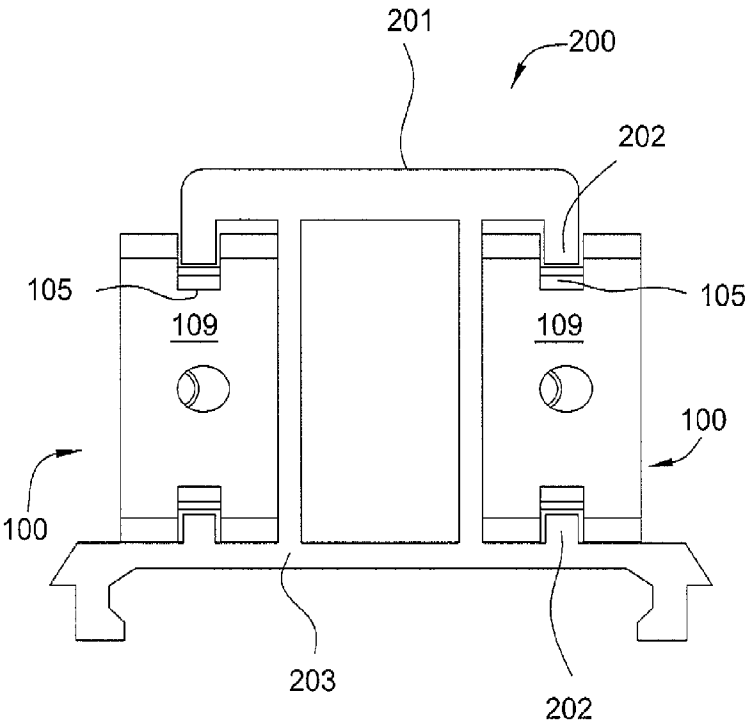
FIG. 5 illustrates one embodiment of a portion of a railing system in which the mounting bracket 100 of FIGS. 1-4 is installed.

FIG. 5 illustrates one embodiment of a portion of a railing system 200 in which the mounting bracket 100 of FIGS. 1-4 is installed. In particular, FIG. 5 shows the placement of the mounting bracket 100 within the sub rail 201 during installation of the railings system 200

As illustrated, the mounting bracket 100 is fit to the sub rail 201 such that the channel 105 of the mounting bracket 100 such that flanges 202 of the sub rail 201 fit within the channel 105 of the mounting bracket 100. The curvature of the channel 105 (including the beveled, smoothly curved, or partially chamfered portions) allows for the mounting bracket 100 to be rotated to any installation angle while remaining in place relative to the flanges 202 of the sub rail 201.

As also illustrated, the sub rail configuration is substantially symmetrical. Thus, one mounting bracket 100 is installed on either side of the center of the sub rail 201.

Figure 6:
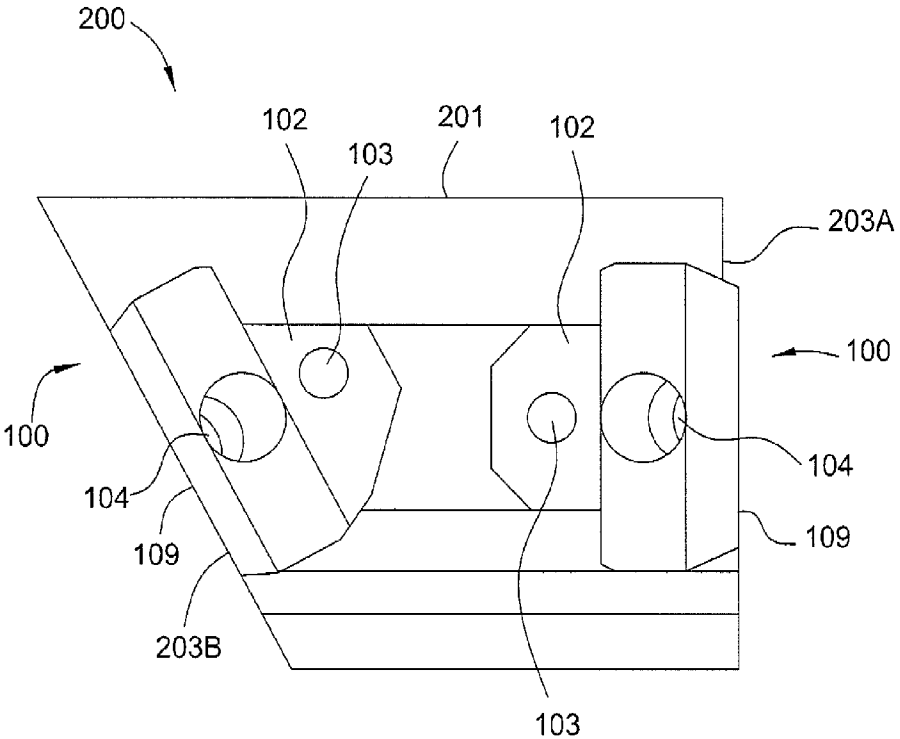
FIG. 6 is a side view illustrating the portion of the railing system of FIG. 5.

FIG. 6 is a side view illustrating the portion of the railing system 200 of FIG. 5. In particular, FIG. 6 illustrates two possible installation angles for the mounting bracket 100. On the right hand side of FIG. 6, the sub rail 201 is installed in a perpendicular orientation relative to a support surface (not shown). In this embodiment, the mounting bracket 100 is rotated such that the third surface 109 of the mounting bracket 100 is substantially flush with the end 203A of the sub rail 201.

On the left hand side of FIG. 6, the sub rail 201 is installed in an angled orientation (e.g., acutely angled) relative to the support surface (not shown). In this embodiment, the mounting bracket 100 is rotated such that the third surface 109 of the mounting bracket 100 is substantially flush with the end 203B of the sub rail 201. The end 203B of the sub rail 201 in this embodiment is cut at an angle.

Figure 7:
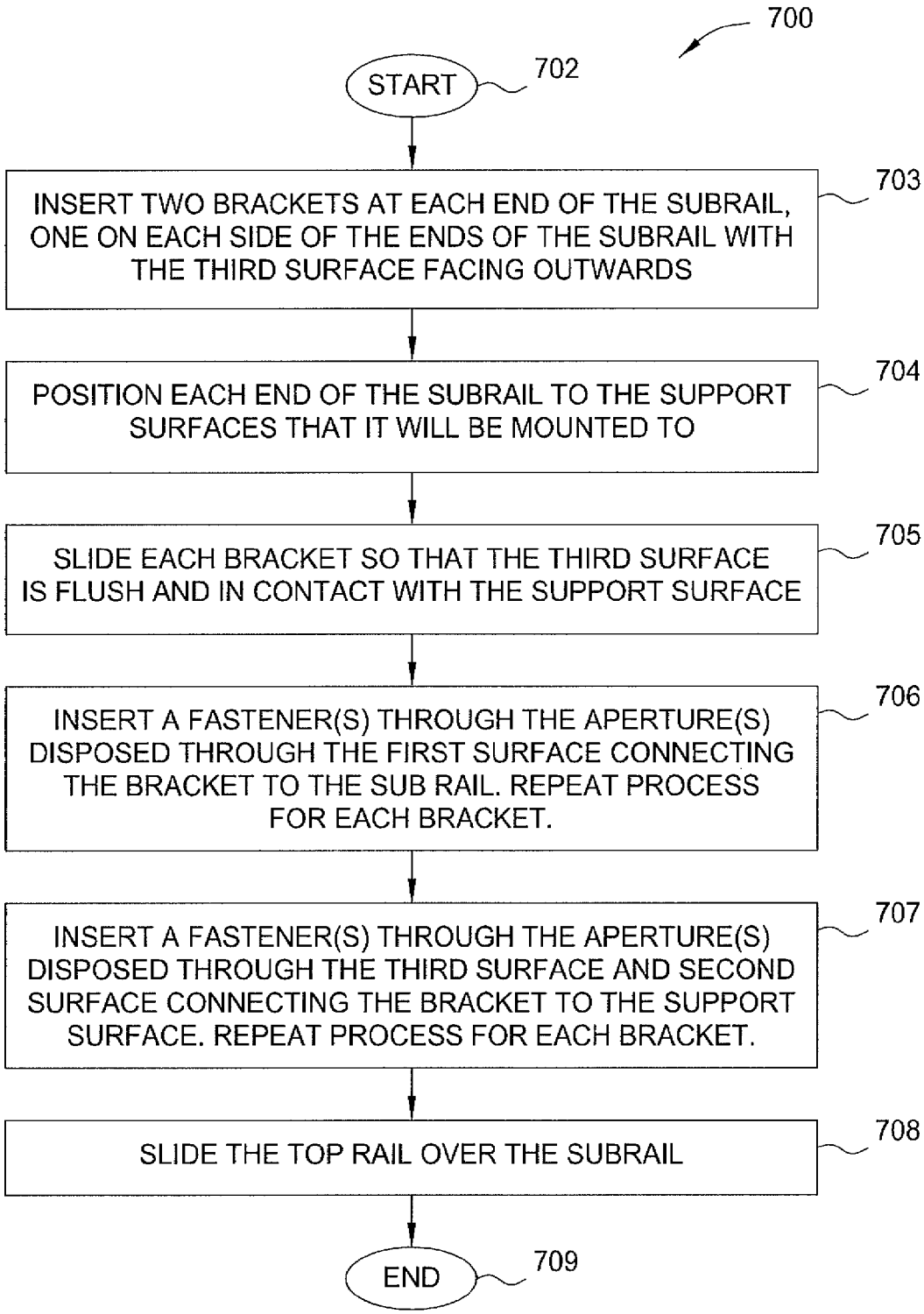
FIG. 7 is a flow diagram illustrating one embodiment of a method for installing a railing system, according to the present invention.

FIG. 7 is a flow diagram illustrating one embodiment of a method 700 for installing a railing system, according to the present invention. FIGS. 5-6, along with the flow diagram in FIG. 7, aid in illustrating the installation of a railing system. Thus, reference may be made simultaneously to FIGS. 5-7 in order to enhance understanding of the method 700 illustrated in FIG. 7.

The method 700 is initialized at step 702 and proceeds to step 703, where two mounting brackets 100 are positioned at the end 203 of a sub rail 201. In particular, one mounting bracket 100 is positioned on either side of the center of the sub rail 201 as depicted in FIG. 5. The mounting brackets 100 are positioned such that the flanges 202 of the sub rail 201 fit within the channels 105 of the mounting brackets 100, with the third surfaces 19 of the mounting brackets facing the support surface (not shown).

In step 704, the sub rail 201 is positioned such that the end 203 is situated flush against the support surface. In step 705, the mounting brackets 100 are then adjusted so that the third surfaces 109 of the mounting brackets 100 are situated flush with the end 203 of the sub rail 201. In one embodiment, the end 203 of the sub rail 201 is orientated at an angle relative to the support surface, so the mounting bracket 100 is rotated in order to mimic the angle at which the sub rail 201 meets the support surface. In another embodiment, the end 203 of sub rail 201 is orientated substantially perpendicular relative to the support surface, so the mounting bracket 100 is rotated to mimic the perpendicular positioning. Regardless of the embodiment, the third surface 109 of the mounting bracket 100 will make flush contact with the support surface.

In step 706, fasteners are inserted through the apertures 103 disposed through the first surfaces 102 of the mounting brackets 100. This secures the mounting brackets 100 to the sub rail 201 at the desired angles.

In step 707, fasteners are inserted through the apertures 104 disposed through the third surfaces 109 and the second surfaces 101 of the mounting brackets 100. This secures the mounting brackets 100, and consequently the sub rail 201, to the support surface.

In step 708, the top rail (not shown) is slid over the sub rail 201, thereby completing the installation process of the railing system 200. The method 700 is terminated in step 709.

Thus, the present invention represents a significant advancement in the field of railing systems. Embodiments of the present invention provide a uniform mounting bracket that is capable of securing a sub rail to a support surface at substantially any relative angle.

Although various embodiments which incorporate the teachings of the present invention have been shown and described in detail herein, those skilled in the art can readily devise many other varied embodiments that still incorporate these teachings.

What is claimed is:

1. A bracket for mounting a rail to a support surface, comprising:

a first surface having a first perimeter;

a second surface having a second perimeter and positioned in a substantially parallel orientation relative to the first surface;

a third surface connecting the first surface and the second surface in a spaced apart manner and defining a perimetric channel between the first perimeter and the second perimeter;

a first aperture formed only through the first surface; and a second aperture formed only through the second surface and through the third surface, wherein the second aperture has a central axis that is disposed at an acute angle relative to the third surface;

wherein at least one of the first perimeter or the second perimeter is at least partially curved.

2. The bracket of claim 1, wherein the bracket is formed of a metal.

3. The bracket of claim 2, wherein the metal is a diecast metal.

4. The bracket of claim 1, wherein the bracket is formed of a polymer or a polymer-based substance.

5. The bracket of claim 4, wherein the polymer-based substance is vinyl.

6. The bracket of claim 1, wherein the at least one of the first perimeter or the second perimeter is beveled.

7. The bracket of claim 1, wherein the third surface is positioned in a substantially perpendicular orientation relative to the first surface and to the second surface.

8. The bracket of claim 7, wherein the second aperture is disposed through a portion of the second surface that is sloped towards the third surface.

9. The bracket of claim 1, wherein the at least one of the first perimeter or the second perimeter is curved smoothly.

10. The bracket of claim 1, wherein the at least one of the first perimeter or the second perimeter is chamfered.

11. The bracket of claim 1, wherein the perimetric channel has a curvature that mimics a curvature of the at least one of the first perimeter or the second perimeter.

12. The bracket of claim 11, wherein the curvature of the perimetric channel is beveled.

13. The bracket of claim 11, wherein the curvature of the perimetric channel is smoothly curved.

14. The bracket of claim 11, wherein the curvature of the perimetric channel is chamfered.

* * * * *